United States Patent [19]

Damin et al.

[11] Patent Number: 4,749,499

[45] Date of Patent: Jun. 7, 1988

[54] METHOD FOR PREPARING VERY FLUID OVERBASED ADDITIVES HAVING A HIGH BASICITY AND COMPOSITION CONTAINING THE ADDITIVES

[75] Inventors: Bernard Damin, Oullins; Roger J. Gallo, Bouc Bel Air; Paul Maldonado, Castanet Tolosan; Pierre Hoornaert, Saint Pierre de Chandieu, all of France; Simon Paley, Yaounde, Cameroon

[73] Assignee: Elf France, Courbevoie, France

[21] Appl. No.: 913,540

[22] Filed: Sep. 30, 1986

[30] Foreign Application Priority Data

Oct. 3, 1985 [FR] France ..... 85 14664

[51] Int. Cl.[4] ..... C10M 125/22; C10M 135/10

[52] U.S. Cl. ..... 252/33.3; 252/18; 252/25; 252/33; 252/33.4; 252/39; 252/40.7

[58] Field of Search ..... 252/33.3, 40.7, 18, 252/25, 39

[56] References Cited

U.S. PATENT DOCUMENTS

| | | | |
|---|---|---|---|
| 3,857,790 | 12/1974 | Saunders et al. | 252/40.7 |
| 3,928,216 | 12/1975 | Saunders et al. | 252/40.7 |
| 4,206,062 | 6/1980 | Derbyshire et al. | 252/33.3 |
| 4,302,342 | 11/1981 | Demoures et al. | 252/40.7 |
| 4,347,147 | 8/1982 | Allain et al. | 252/33.4 |
| 4,435,301 | 3/1984 | Brannen et al. | 252/33.3 |
| 4,464,289 | 8/1984 | Le Coent et al. | 252/40.7 |
| 4,470,916 | 9/1984 | Le Coent et al. | 252/40.7 |

FOREIGN PATENT DOCUMENTS 005337 4/1979 European Pat. Off. .

*Primary Examiner*—William R. Dixon, Jr.
*Assistant Examiner*—Ellen McAvoy
*Attorney, Agent, or Firm*—Burgess Ryan & Wayne

[57] ABSTRACT

This invention concerns a process for preparing very fluid overbased additives having a high basicity, by contacting an alkaline-earth metal derivative and at least one surfactant with carbon dioxide in a diluent oil and a hydrocarbon-based solvent in the presence of an oxygen-based promoter and a nitrogen-based promoter wherein the carbonation time is comprised between an initial point Po corresponding to the beginning of the temperature plateau of the exothermic reaction and the end point of the carbonation which corresponds to a sudden drop of the alkaline value, the additives according to the invention being utilized in lubricating oils and fuels.

19 Claims, No Drawings

METHOD FOR PREPARING VERY FLUID OVERBASED ADDITIVES HAVING A HIGH BASICITY AND COMPOSITION CONTAINING THE ADDITIVES

BACKGROUND OF THE INVENTION

1. Field of the Invention

The present invention relates to a method for the synthesis of very fluid overbased additives having a high basicity.

Overbased additives are alkaline-earth metal salts of organic acids, overbased through carbonation with carbon dioxide. The term "overbased" is used to designate the excess of alkaline-earth metal with respect to the stoechiometric quantity necessary to neutralize the organic acid used.

2. Description of the Prior Art

These overbased additives have been used in lubricating oils for many years. They have the property of neutralizing the acidity developed in motors by the combustion of sulfur-based organic derivatives contained in the fuels as well as by the oxidation of the components of the oils that occurs during running of the motors employed in land vehicles or marine craft.

The use of fuels containing increasingly high amounts of sulfur, in particular fuel for heavy fuel motors, associated to increasingly stringent operating conditions, renders indispensable the use of lubricating compositions capable of neutralizing the large quantities of acids formed during combustion.

The overbased additives are also applied as anticorrosive agents in burner boilers using fuel since they preferentially complex the vanadium compounds and oxides present in the fuels. The compound that is normally deposited on the walls of furnaces during combustion is at the origin of the oxidation and the corrosion of the furnaces. The alkaline-earth metals, and especially magnesium, form with vanadium oxides high melting point eutectics, which do not stick to the wall of the furnace pipes.

The basicity of these overbased products is characterized by their alkaline value AV which is expressed in milligrams of KOH per gram of overbased additive titrated by a strong acid according to ASTM D 2896 standard.

The overbased additives must have high alkaline values, generally higher than or equal to 250. Thereafter, the viscosity of these products must be sufficiently low to facilitate their handling and utilization. Furthermore, they must be translucid without any trace of mineral particles in suspension. The solids in suspension will hamper the effect desired by provoking an abrasion of the motors and burners. Furthermore, they must conserve their limpid aspect and retain a homogeneous consistency with time.

Numerous processes for the preparation of overbased additives already exist.

European patent application No. 005337 describes a process that consists in carbonating an alkylarylsulfonate and magnesium oxide mixture in a diluent oil and in xylene, in the presence of methanol, water and ammonia.

According to British patent application No. 2 055 885 methanol is replaced by ethoxyethanol, thereby allowing overbased products having reduced viscosity to be obtained.

British patent applications No. 2 114 993 and 2 037 310, and European patent application No. 013 807 as well as French patent No. 2 528 224 claim replacing methanol by respectively dioxolan, a methanol-carbon dioxide mixture, a methanol-diacetone mixture or diglycol.

Furthermore, U.S. Pat. No. 4,347,147 claims the use of ethylenediamine as a substituent of ammonia.

U.S. Pat. No. 3,929,217 proposes a method of carbonation without the addition of water.

All these processes are difficult to reproduce commercially and often lead to doughy or solid products. In other cases, low alkaline values (AV) are obtained that do not allow the obtention of the desired performances in the motors or in the furnaces. The processes described for an alkaline-earth metal cannot be transported to other metals due to the difference in reactivity of these other metals.

A simple and commercially reproductible process has now been developed that allows the obtention of overbased additives having very high alkaline values and low viscosity, this process being industrially feasible, whatever the type of alkaline or alkaline-earth metal used.

SUMMARY OF THE INVENTION

The process for preparing the overbased additives according to the invention consists in contacting a derivative of the alkaline-earth metal and of at least one surfactant with carbon dioxide in a diluent oil and a hydrocarbon-based solvent in the presence of an oxygen-based promoter and a nitrogen-based promoter.

The optimal duration of the carbonation is comprised between an initial point Po corresponding to the beginning of the temperature plateau of the exothermic reaction and the end point of the carbonation operation, which corresponds to a sudden drop of the alkaline value.

The prior art considered that the AV of an overbased product in the presence of amino-based promoters continues to increase during the entire duration of the addition of the carbon dioxide (patent application No. 005337). It has been observed in a surprising and unexpected manner that the AV passes by a maximum, a time t after the beginning of the temperature plateau, levels off at this value and then drops suddenly.

The optimal duration of the carbonation is comprised between the beginning of the temperature plateau and the sudden drop of the AV. This is determined by dosage of the AV.

This duration depends to a large extent upon the alkaline-earth metal used; it is for example, longer for magnesium than for calcium. Measuring the optimal carbonation duration allows correct adaptation of the process to the metal involved.

In order to determine the optimal duration of the carbonation, there is introduced into a reactor the surfactant, the alkaline-earth metal derivative, the diluent oil, the hydrocarbon-based solvent and the oxygen-based and nitrogen-based promoter. The mixture is subjected to vigorous stirring prior to the introduction of the carbon dioxide.

Since the reaction is exothermic, a distinct increase in temperature is noted. The temperature rises until it reaches a plateau. The carbonation continues while determining the AV on samples drawn off at regular time intervals. This alkaline value increases, reaches a plateau then drops suddenly. The optimal duration of the carbonation occurs during the period prior to this drop.

It should be noted than when operating occurs in large capacity reactors, it is important that the temperature of the reaction medium does not exceed a maximum value beyond which the stability of the finished products will be compromised. In this case, the exothermicity of the reaction is traced by the temperature of the reaction medium and the thermal flow with respect to the refrigeration exchanger of the reactor.

The term "surfactant" designates a molecule comprising a lipophilic hydrocarbon-based part and a hydrophilic part. The hydrophilic part can be a sulfonic, carboxylic, phenolic, phosphonic or thiophosphonic acid group. These compounds are used in their metal salts form. On the contrary, the surfactants based on nitrogen compounds, such as amines, amides, imines and imides do not require the presence of metallic atoms.

Among the surfactants the most frequently used are the sulfonates and especially the alkylarylsulfonates such as alkylbenzenesulfonates, alkylxylenesulfonates and alkyltoluenesulfonates having a linear or branched alkyl chain with 9 to 36 carbon atoms. The dialkylbenzenesulfonates, such as $C_{24}$-alkylbenzenesulfonate are most particularly suitable.

Among the alkaline-earth metals are preferably used, calcium, magnesium or barium in the hydroxide, alcoholate or oxide form. The invention one to adapt the overbasing process to the utilization of different metals. The most currently used are the calcium or magnesium oxides. The "light" oxides that have been calcinated at lower temperatures have generally a better reactivity.

The function of the diluent oil is to allow easy handling at ambient temperature. Among these diluent oils can be cited the paraffinic oils such as 75, 100 or 100 Neutral® solvent or the naphthenic oils such as 100 Pale® solvent.

The hydrocarbon-containing solvent has an aliphatic or aromatic structure. The most frequently used solvents are toluene, xylene, heptane and nonane.

The oxygen-based promoters are most frequently $C_1$ to $C_5$ aliphatic alcohols, the most often methanol, but also ethanol or glycol. Dioxolan and water, alone, or mixed with an alcohol, can also be used.

The nitrogen-based promoters are, among others, ammonia, ammonium chloride, ammonium carbonate or ethylenediamine. According to the prior art, ammonium carbonate is prepared through bubbling of carbon dioxide in ammonia, prior to or during the reaction. In a surprising and unexpected manner, it has been observed that the inroduction of ammonium carbonate in the pure crystal form into the reaction medium, gives additives of improved quality, having higher AV and lower viscosities.

It can be preferable to use ethanolamine, which acts as nitrogen-based and oxygen-based promoter.

The ethanolamine is advantageously used in a molar ration comprised between 2 and 10 with respect to the surfactant.

According to one preferred embodiment of the invention, into a reactor is introduced a mixture of diluent oil and 100 parts by weight of a hydrocarbon-containing solvent, then 5 to 45 parts by weight of an alkylarylsulfonic acid, from 2 to 30 moles of an oxide or a hydroxide of alkaline-earth metal and from 0.2 to 20 moles of oxygen-based promoter per surfactant mole. The mixture being maintained under vigorous stirring, a change of color is observed after addition of the oxygen-based promoter which corresponds to the formation of the alkaline-earth metal sulfonate; Thereafter, 0.1 to 1 mole of amino-based promoter is added per mole of surfactant and water.

The mixture is stirred sufficiently to maintain in suspension the alkaline-earth metal oxide. The carbon dioxide is introduced either through bubbling, or by putting the reactor under constant pressure of carbon dioxide. This process is described in the French patent application having for title "procédé de préparation d'additifs, par carbonation sous pression constante d'anhydride carbonique", filed on the same day as the French application of which the present invention claims priority under No. 85 14662.

The molar ratio of the carbon dioxide with respect to the alkaline-earth metal derivative is comprised between about 0.2 and 5.

Since the reaction is exothermic, it is not necessary to heat. After a significant increase, the temperature reaches a plateau. The introduction of carbon dioxide continues while tracing the evolution of the alkaline value on the samples drawn off at regular intervals in the medium.

The optimal duration of carbonation extends up to the period prior to the drop of the AV.

This optimal duration is relatively long in the case of using magnesium oxide; it is shorter for calcium oxide.

According to the prior art the carbonated reaction mixture undergoes a first distillation that allows the water, ammonia and alcohol to be eliminated. The distillation residue is filtered in order to separate the excess alkaline-earth derivative then the filtrate is again distilled in order to be freed from the hydrocarbon-containing solvent.

This process is delicate to carry out: the filters clog during the filtering operation, and the distillation is accompanied by considerable foaming, thereby carrying along the overbased product.

It is therefore preferable to eliminate the solid residues by centrifugation. The solvents and the promoters can be eliminated according to known methods by successive distillation steps or in a single evaporation step after centrifugation of the solid residues.

The obtained overbased product is in the form of a clear brown colored translucid fluid oil.

It is characterized by its alkaline value AV determined by direct potentiometric dosage according to the ASTM D 2896 standard, its alkaline-earth metal content being determined by plasma torch and its cinematic viscosity at 100° C.

The overbased products according to the invention are used as additives in lubricating oils of a natural or synthetic origin. They are used at a concentration comprised between 0.1 and 30% by weight and preferably between 0.5 and 15% by weight, according to the applications envisaged.

These overbased products are also used as fuel additives in order to confer magnesium contents comprised between 5 and 200 ppm with respect to the fuel.

EXAMPLE 1

Into a 250 ml capacity reactor provided with a stirrer, a carbon dioxide intake, a dropping funnel, a cooling agent and a thermometer are succesfully introduced: 33.6 g of sulfonic $C_{24}$-alkylbenzene acid at 70%, 24 g of calcium oxide, 18 g of 100 Neutral® oil, 120 ml of xylene and 12 ml of methanol, 8.4 ml of distilled water and 0.928 g of ammonium carbonate.

The mixture is stirred at 200 rpm, while beginning the introduction of the carbon dioxide at a flow-rate of 82.4 ml/minute.

The reaction is exothermic; after 15 to 20 minutes a temperature plateau is reached at about 60° C. (Po). The carbonation is continued from point Po and samples are drawn off after respectively 5, 25, 40, 55, 70 and 80 minutes. Each sample is centrifuged and the solvents are eliminated by evaporation prior to determination of the AV by the method according to ASTM D 2896 standard.

Table I resumes the AV in function of the carbonation time after the beginning of the plateau temperature (Po).

TABLE I

| Carbonation time from Po in minutes | AV |
|---|---|
| 5 | 180 |
| 25 | 270 |
| 40 | 325 |
| 55 | 376 |
| 70 | 381 |
| 80 | 124 |

The optimal carbonation time after the point Po is 70 minutes. The viscosity of the mixture is 134 cSt at 100° C. It is in the form of a clear brown colored translucid fluid oil.

EXAMPLE 2

Into a 250 ml capacity reactor provided with a stirrer, a carbon dioxide intake, a dropping funnel, a cooling agent and a thermometer, are introduced: 20.5 g of sulfonic $C_{24}$-alkylbenzene acid at 70%, 21.34 g of magnesium oxide, 22.5 g of diluent oil (100 Neutral ®), 150 ml of xylene and 14.5 ml of methanol.

The mixture is stirred at 200 rpm. A solution of 2.37 ml ammonia and 10.5 ml water (preferably carbonated up to the curve of the phenolphthaleine) is added over 30 minutes to the mixture while beginning the introduction of the carbon dioxide at a speed of 130 ml/min. The reaction is exothermic. The optimal carbonation time determined as in example 1 is 4 h 05 min.

Upon completion of the reaction, the mixture is subjected to a centrifugation in order to eliminate the residual solids.

The liquid phase is subjected to an evaporation step in order to eliminate the volatile components ($NH_2$, water, methanol, xylene) and an overbased product having an alkaline value of 426 mg of KOH/g, 10.24% of Mg and a viscosity of 80 cSt at 100° C. is obtained.

EXAMPLE 3

The experiments described in example 2 are repeated under identical operating conditions, except for the fact that 30 g of magnesium oxide and 15 ml of methanol are used.

An overbased product having an alkaline value of 445 mg of KOH/g, 10.16% of Mg and a viscosity of 140 cSt at 100° C. is obtained.

EXAMPLE 4

The experiments described in example 2 are repeated under identical operating conditions, except for the fact that ammonia is replaced by 1.16 g of ammonium carbonate.

An overbased product having an alkaline value of 148 mg of KOH/g, 11.1% of Mg and a viscosity of 54 cSt at 100° C. is obtained.

This example illustrates that the utilization of ammonium carbonate leads to the obtention of a very fluid product.

EXAMPLE 5

The experiments described in example 3 are repeated under identical operating conditions, except for the fact that the ammonia is replaced by 1.16 g of ammonium carbonate.

An overhead product having an alkaline value of 443 mg of KOH/g, 10.8 g of magnesium and a viscosity of 57 cSt at 100° C. is obtained.

This example illustrates that one of the advantages in utilizing ammonium carbonate is the obtention of a producting having a very low viscosity.

EXAMPLE 6

The experiments described in example 2 are repeated under identical operating conditions, except for the fact that 28 g of magnesium oxide and 15 ml of methanol are used and the ammonia is replaced by 1.16 g of ammonium carbonate and the optimal duration of the carbonation step is 2 h 10 min.

An overbased product having an alkaline value of 468 mg of KOH/g, 11.5% of magnesium and a viscosity of 118 cSt at 100° C. is obtained.

EXAMPLE 7

The experiments described in example 6 are repeated under identical operating conditions, except for the fact that 13.73 g of magnesium oxide and 8 ml of methanol are used and the carbonation time is 4 h 05 min. An overbased product having an alkaline value of 397 mg of KOH/g, 10.0% of Mg and a viscosity of 44 cSt at 100° C. is obtained.

EXAMPLE 8

The experiments described in example 6 are repeated under identical operating conditions, except for the fact that no methanol nor ammonium carbonate are utilized. On the other hand, 23.84 g of ethanolamine are used. The quantity of magnesium oxide introduced into the reactor is 14 g.

An overbased fluid product having an alkaline value of 360 mg of KOH/g is obtained.

EXAMPLE 9

In a 250 ml capacity reactor, provided with a stirrer, a carbon dioxide intake, a cooling agent and a thermometer, the following are introduced: 42 g of $C_{24}$-alkylbenzenesulfonic having an acid rate of 70%, 23 g of calcium oxide, 21.6 g of diluent oil (100 Neutral ®), 146 ml of xylene, 10 ml of methanol and 6 ml ammonia.

The mixture is subjected to a strong stirring (700 rpm) during which time the introduction of the carbon dioxide begins at a speed of 100 ml/min.

The reaction is exothermic. The temperature rises to about 54° C. The optimal carbonation time is 60 min.

At the end of the reaction, 50 ml of xylene are added to the mixture which thereafter undergoes a centrifugation in order to eliminate the residual solids.

The liquid phase is subjected to an evaporation step in order to eliminate the volatile components ($NH_3$, water, methanol, xylene).

Overbased calcium sulfonate having an alkaline value of 320 mg of KOH/g, 17.3% of Ca and a viscosity of 66 cSt at 100° C. is obtained.

EXAMPLE 10

The experiments described in example 9 were repeated under identical operating conditions, except for the fact that 30 g of calcium oxide, 22.5 g of diluent oil, 150 ml of xylene, 15 ml of methanol and a solution of 1.16 g of ammonium carbonate in 10.5 g of water (instead of ammonia) are utilized.

Overbased calcium sulfonate having an alkaline value of 413 g of KOH/mg, 21.8% of Ca and a viscosity of 134 cSt is obtained.

EXAMPLE 11

Into a 250 ml capacity reactor provided with a stirrer, a carbon dioxide intake, a dropping funnel, a cooling agent and a thermometer, the following are introduced:

44 g of $C_{24}$-alkylbenzene sulfonic acid at 70%
42 g of calcium hydroxide
16.9 g of diluent oil (100 Neutral®)
112 ml of xylene, and
10 ml of methanol.

The mixture is stirred at 300 rpm. To the reaction medium is thereafter added 2.2 g of water and 0.76 g of crystallized ammonium carbonate while beginning the introduction of carbon dioxide at a flow-rate of 65 ml/min. The optimal carbonation time determined as in example 1 is 1 h 05 min.

After centrifugation of the medium and evaporation of the solvents, an overbased product having an AV of 369 mg of KOH/g and a viscosity of 153 cSt at 100° C. is obtained.

EXAMPLE 12

The experiment described in example 11 is repeated under identical operating conditions, except for the fact that 30 g of calcium oxide and 31.1 g of $C_{13}$-alkylxylene sulfonic acid at 95% of active material is utilized. The optimal carbonation time is 63 minutes for a flow-rate of 90 ml/min.

The overbased product recovered is characterized by an AV of 433 mg of KOH/g and a viscosity of 227 cSt at 100° C. This example illustrates the possibility of utilizing an alkylxylene sulfonic acid instead of a $C_{24}$-alkylbenzene sulfonic acid.

EXAMPLE 13

The experiment described in example 12 is repeated under identical operating conditions, except for the fact that a 100 Pale® solvent naphthenic oil is used as diluent oil.

An additive having an AV of 395 mg of KOH/g and a viscosity of 182 cSt at 100° C. is obtained.

We claim:

1. A process for preparing fluid overbased agents having a high basicity which comprises: forming a mixture of a derivative of an alkaline-earth metal, at least one surfactant, a diluent oil, a hydrocarbon-containing solvent, an oxygen-base promoter and a nitrogen-based promoter, and carbonating the mixture by contacting the mixture with carbon dioxide for a carbonation time comprised between an initial point Po which corresponds to the beginning of the temperature plateau of the exothermic reaction and the end point of the carbonation which corresponds to a sudden drop in the alkaline value.

2. Process according to claim 1, wherein the alkaline-earth metal derivative is magnesium oxide or hydroxide.

3. Process according to claim 1, wherein the alkaline-earth metal derivative is calcium oxide or hydroxide.

4. Process according to claim 1, wherein the surfactant is an alkylarylsulfonate selected from the group consisting of $C_9$ to $C_{36}$ linear or branched long chain alkylbenzenesulfonates, alkylxylenesulfonates and alkyltoluenesulfonates.

5. Process according to claim 4, wherein the surfactant is a $C_{24}$dialkylbenzenesulfonate.

6. Process according to claim 1, wherein the diluent oil is a paraffinic oil.

7. Process according to claim 1, wherein the hydrocarbon-based solvent is an aromatic solvent.

8. Process according to claim 7, wherein the aromatic solvent is xylene.

9. Process according to claim 1, wherein the oxygen-based promoter is at least a compound of the group formed by alcohol and water.

10. Process according to claim 9, wherein the alcohol is a $C_1$ to $C_5$ aliphatic alcohol.

11. Process according to claim 10, wherein the alcohol is methanol or ethanol.

12. Process according to claim 1, wherein the nitrogen-based promoter is selected from among ammonia, ammonium chloride, ammonium carbonate or ethylenediamine.

13. Process according to claim 12, wherein the ammonium carbonate is introduced in the form of pure crystals into the reaction medium.

14. Process according to claim 1, wherein ethanolamine is utilized as single promoter and in a molar ratio comprised between 2 and 10 with respect to the surfactant.

15. Process according to claim 1, wherein the overbased additive is isolated from the carbonated mixture by centrifugation of the solid residues and evaporation of the solvents.

16. Lubricating composition comprised of a natural or synthetic lubricating oil and from 0.1 to 30% by weight of an overbased additive prepared according to claim 1.

17. Process according to claim 6, wherein said paraffinic oil is 100 Neutral R oil.

18. Process according to claim 6, wherein said paraffinic oil is a naphthenic oil.

19. Lubricating composition according to claim 16 wherein the overbased additive is present in an amount of from 0.5 to 15% by weight.

* * * * *